United States Patent [19]

Thomas et al.

[11] Patent Number: 4,759,834

[45] Date of Patent: Jul. 26, 1988

[54] PROCESS FOR THE ELECTROCHEMICAL OXIDATION OF ORGANIC PRODUCTS

[75] Inventors: Andreas M. J. Thomas, Kerkrade; Franciscus van den Brink, Geldrop; Rudolf van Hardeveld, Geleeen, all of Netherlands

[73] Assignee: Stamicargon B. V., Geleen, Netherlands

[21] Appl. No.: 72,738

[22] Filed: Jul. 13, 1987

[30] Foreign Application Priority Data

Jul. 12, 1986 [NL] Netherlands ..... 8601826

[51] Int. Cl.[4] ..... C25G 3/02

[52] U.S. Cl. ..... 204/78; 204/293

[58] Field of Search ..... 204/78, 293

[56] References Cited

U.S. PATENT DOCUMENTS 4,380,493 4/1983 Wortley et al. ..... 204/293

4,411,746 10/1983 Degner et al. ..... 204/78

*Primary Examiner*—R. L. Andrews

*Attorney, Agent, or Firm*—Cushman, Darby & Cushman

[57] ABSTRACT

The invention relates to a process for the electrochemical oxidation of organic products at a lead-silver anode in acid medium, in which process the organic products used are alkyl-substituted heterocycles and in which process a lead-silver anode with 2–10% (wt) silver is used.

8 Claims, No Drawings

PROCESS FOR THE ELECTROCHEMICAL OXIDATION OF ORGANIC PRODUCTS

The invention relates to a process for the electrochemical oxidation of organic products at a lead-silver anode in an acid medium. Such a process is known from the handbook 'Elektroorganische Chemie, Grundlagen und Anwendungen' by F. Beck, published by Verlag Chemie, 1974, page 99. It has been known for a much longer time that in such oxidation reactions lead electrodes have been used. It should otherwise be noted that under operating conditions the lead of the anode is oxidized at least in part to form lead dioxide. To such a lead electrode sometimes up to 1% (wt) silver was added in order to come to a greater stability in acid medium. Besides, low concentrations of other elements were sometimes added, again to increase the corrosion stability (see e.g. M. M. Baizer, 'Organic Electrochemistry An Introduction and a Guide', 1973, Marcel Dekker (New York), p. 201).

It is known per se from the handbook 'Industrial Electrochemical Processes', edited by A. T. Kuhn, 1971, Elsevier Publishing Company, page 536, that the chosen lead-silver content of the electrode must be such that no free silver is present in the system, or less silver than at the eutectic point, which is at 2.6% (wt) silver. In practice lead-silver electrodes with 1% (wt) silver are known to be good, mechanically strong and corrosion-resistant electrodes.

In the doctoral thesis by R. Huss, Technological University of Munich, 1976, page 127, it is described that the use of a lead anode in the oxidation of $\beta$-picoline in acid medium in a divided cell results in a dark-brown anolyte. Applicant's own experiments have revealed that also when using a lead-silver anode with 1% (wt) silver the anolyte takes on a dark colour owing to the formation of tar. This tar formation has been found to occur in many electrochemical oxidation reactions of organic products.

The object of the invention is to provide a process for the electrochemical oxidation of organic products in which the said tar formation does not occur, or hardly so. The process according to the invention for the electrochemical oxidation of organic products is characterized in that the organic products used are alkyl-substituted heterocycles and in that a lead-silver anode is used with 2–10% (wt) silver. When using an anode with such amounts of silver, from slightly below the eutectic point to 10% (wt) (about the limit above which the anode rather assumes the character of a real silver anode resulting in, for instance, a dominant formation of oxygen), the process for the electrochemical oxidation of alkyl-substituted heterocycles has been found not to result in the formation of tar products, or hardly so.

It should otherwise be noted that lead-silver electrodes with a higher silver content are known in processes other than the electrochemical oxidation of organic products. For instance, Korczynski (Zesz. Politech. Slask, Chem., 1969, 47, pp. 3–14; C.A. 71, (1), 9047 u (1969)) describes the electrosynthesis of organic hydrochlorides, in which preference is expressed for electrodes with a maximum of 1% (wt) silver; with 1–3% (wt) silver the anode surface gradually disappears and with 4–10% (wt) silver the scale drops away as particles. In U.S. Pat. No. 2,198,045 lead-silver anodes are used with a silver content of 2.5 to 7.5% (wt) (so above the eutectic point) in the electrolysis of aqueous alkalisulphate solutions, in which process wearing of the anodes in consequence of the formation of lead peroxide during the electrolysis is virtually completely suppressed if the anode temperature is kept below 50°C.

The anodes used in the process according to the invention have an excellent mechanical strength and are corrosion-resistant in acid medium.

In the process according to the invention preference is given to the use of a lead-silver anode with 2.6–8% (wt) silver, because with this amount of silver the formation of tar is minimal.

In applying the process according to the invention one or more other metals may be added to the lead-silver anode, for instance antimony, cadmium, calcium, cobalt, tellurium, thorium, tin or zinc. In that case the anodes are even more stable, which means that the residence time of the anode is increased. These metals can be added in amounts which are generally 0.01–0.7% (wt).

The process according to the invention can be applied in a divided as well as in an undivided cell.

The acid used may be, for instance, sulphuric acid or phosphoric acid in concentrations of 0.1–50% (wt). Other acids in which lead dioxide does not dissolve can also be used.

The current density that is generally applied in such electrochemical oxidation reactions is 100–10,000 $A/m^2$.

The process according to the invention can be applied—without, or with very low, tar formation—for the electrochemical oxidation of organic products as described, for instance, in the handbook 'Elektroorganische Chemie, Grundlagen und Anwendungen' by F. Beck (Verlag Chemie, 1974), pp. 270–276, or in 'Organic Electrochemistry—An Introduction and a Guide' by M. M. Baizer (Marcel Dekker, New York 1973) pp. 995–1029. Such organic products are, for instance, substituted aromatic hydrocarbons, saturated and unsaturated alcohols and aldehydes, amines and substituted heterocycles.

The process is particularly suited for the electrochemical oxidation of alkyl-substituted heterocycles, such as thiophenes, furans, dioxans, indoles, imidazoles, thiazoles, pyridines, pyrimidines, pyrroles.

By preference alkyl-substituted N-heterocycles are oxidized in this manner, such as mono and dimethyl-substituted pyridines.

Applicant has also found that an extra problem may arise in the electrochemical oxidation of various alkyl-substituted heterocycles into heterocyclic carboxylic acids at a lead-silver anode with up to 2% (wt) silver. The fact is that if such a starting material (e.g. an alkyl-substituted pyridine base) as well as a reaction product (e.g. an alkyl-substituted pyridine carboxylic acid) are present in the anolyte, this reaction product will be oxidized in preference to the starting material when the concentration of the reaction product is higher than, for instance, 2% (wt). Therefore, the concentration of the reaction product in the anolyte will have to be kept low, for instance by continuously removing it. Now, when in such a specific electrochemical oxidation a lead-silver anode according to the invention is used, it will surprisingly be found that further preferential oxidation in low concentrations of the oxidation product formed does not take place. The above-mentioned particularly applies, as described, for instance, in European Patent Application No. 217439, to the electrochemical oxidation of 2,3-lutidine to form 2,3-pyridine dicarboxylic acid (PD C). The invention therefore also provides a process for the electrochemical oxidation of alkyl-substituted heterocycles, notably 2,3-lutidine, in which process the reaction product can be built up to substantially higher concentrations than possible so far, viz. up to even above 4% (wt).

The temperature at which the electrochemical oxidation can be carried out is not of particular importance in itself. A systematic examination will enable the person skilled in the art to determine by simple means at what temperature optimum reaction efficiency is reached. Generally, the chosen temperature will be in the range of 20°-90° C.

The invention will be further elucidated by means of the following examples.

EXAMPLE I In five divided electrolytic cells connected in parallel, having a common catholyte and five separate anolytes, each having an anode with a different silver content, the effects of the composition of various anodes on the electrochemical oxidation of 2,3-lutidine into pyridine dicarboxylic acid were watched in a prolonged experiment (at 25° C.). The anode compartments were separated from the common catholyte by five identical anion-exchange membranes. One anolyte circuit contained 240 g anolyte consisting of 10% (wt) 2,3-lutidine, 20% (wt) $H_2SO_4$ and 70% (wt) water. The catholyte circuit contained $5\times240=1200$ g 2% (wt) $H_2SO_4$ in water. The membranes were of the Selemion AMV type of the firm of Asahi Glass. The distance between membrane and electrode was 10 mm. During the experiment the current density was 1250 $A/m_2$, while the potential difference between the cathode and every anode was about 4.4 Volts. At set times extinction measurements were made with 1:10 water-diluted anolyte at 400 nm.

The results of these extinction measurements are shown in table 1, in which an extinction value of 0.650 is indicative of a solution coloured very dark by the formation of tar. When this value was reached, the extinction measurement was stopped, but the experiment was continued, however.

TABLE 1

| | Extinction measurement anolyte at 400 nm, 1:10 in $H_2O$ | | | | | |
|---|---|---|---|---|---|---|
| Anode | 0 hours | 6 hours | 25 hours | 30 hours | 48 hours | 72 hours |
| Pb | 0.067 | 0.590 | 0.650 | 0.650 | 0.650 | 0.650 |
| Pb 1% Ag | 0.067 | 0.091 | 0.132 | 0.330 | 0.338 | 0.340 |
| Pb 2.5% Ag | 0.067 | 0.090 | 0.090 | 0.100 | 0.132 | 0.146 |
| Pb 5% Ag | 0.067 | 0.082 | 0.089 | 0.089 | 0.099 | 0.112 |
| Pb 7.5% Ag | 0.067 | 0.076 | 0.078 | 0.078 | 0.086 | 0.090 |

This table clearly shows that with Pb/Ag anodes according to the invention the dark colouration owing to the formation of tar is less. In the same series of experiments the 2,3-lutidine and PDC content of every anolyte was determined also after 76.5 hours by means of HPLC.

The results have been expressed as $$\frac{PDC \text{ formed}}{\text{converted 2,3-lutidine}} \times 100\% \text{ (table 2).}$$

This is called selectivity or chemical yield.

Table 2 also shows the percentage of the current passed through, $\eta(O_2)$, which is used for the formation of oxygen from water. The higher this percentage, the lower the current yield ($=100-\eta(O_2)\%$). The determination of the current yield is effected—besides via de HPLC determination—also by the momentary as well as integral recording of the anodic waste gas using a Brooks mass flowmeter and by its analysis with an $O_2$-meter and gaschromatographic CO and $CO_2$ determination.

TABLE 2

| | Anolyte after 76.5 hours | | conversion | selectivity | $\eta(O_2)$ |
|---|---|---|---|---|---|
| Anode | % (wt) 2,3-lutidine | % (wt) PDC | % | % | % |
| Pb | 0 | 2.3 | 100 | 14.7 | 19 |
| Pb 1% Ag | 1.7 | 3.4 | 83 | 26.2 | 32 |
| Pb 2.5% Ag | 1.3 | 4.3 | 87 | 31.7 | 40 |
| Pb 5% Ag | 1.9 | 3.7 | 81 | 29.3 | 46 |
| Pb 7.5% Ag | 2.6 | 3.1 | 74 | 26.8 | 49 |

EXAMPLE II

In a manner similar to that described in Example I β-picoline was oxidized at three different anodes at 40° C. to form nicotinic acid. The anodes contained respectively 0, 1 and 2.75% (wt) silver. The anolyte circuits contained 10% (wt) β-picoline, 20% (wt) $H_2SO_4$ and 70% (wt) water. The other reaction conditions were identical to those in example I, as well as the manner in which the extinctions after 0 and 24 hours were determined.

The results of this example are shown in table 3.

TABLE 3

| | Extinction measurement anolyte at 400 nm, 1:10 in $H_2O$ | |
|---|---|---|
| Anode | 0 hours | 24 hours |
| Pb | 0.070 | 0.650 |
| Pb 1% Ag | 0.070 | 0.432 |
| Pb 2.75% Ag | 0.070 | 0.090 |

Examples I and II clearly show that in these electrochemical oxidation reactions the tar formation is very low if lead-silver anodes with 2-10% (wt) silver are used. Moreover, example I shows that the lead-silver electrodes according to the invention are highly suited for the electrochemical oxidation of 2,3-lutidine to form 2,3-pyridine dicarboxylic acid.

Examples III up to and including VIII below give a more general picture of the applicability of lead-silver electrodes in the electrochemical oxidation of alkyl-substituted heterocycles. All these experiments have been carried out as batch experiments in a parallel-plate electrolytic cell with a distance between the electrodes of 5 mm, the anode and cathode compartments being separated from each other by an anion-exchange membrane (Asahi Glass Selemion ASV). The anode in each of the examples III up to and including VIII was a lead-silver electrode with a silver content of 2.75% (wt); the cathode was a Pt cathode. Both electrodes measured $10\times10$ $cm^2$ in examples III up to and including VI, respectively $4\times4$ $cm^2$ in examples VII and VIII. For the purpose of comparison a number of these experiments have been repeated also with a lead electrode as anode. (The results with the lead anode are always shown between brackets).

In all experiments an anolyte was used composed of 10% (wt) substrate (starting material to be oxidized), 20% (wt) $H_2SO_4$ and 70% (wt) water and a 20%-(wt)-$H_2SO_4$ solution in water as catholyte. The anolyte and catholyte were kept at a constant temperature by recirculation over a heat exchanger.

During the experiments the current was kept at a constant density using a stabilized current source, Delta SM 60–20, and measurements were made of the total charge Q passed through and the cell voltage E. By regularly sampling the anolyte for the purpose of HPLC analyses and by analyzing the anodic waste gas, as indicated in example I, conversions, selectivities and current yields could be determined.

Examples III up to and including VI relate to experiments with various alkyl-substituted heterocycles; example VII gives an impression of the effect of the current density in the conversion of 2,3-lutidine into 2,3-pyridine dicarboxylic acid; example VIII, relating to the same conversion, gives an impression of the effect of the temperature on selectivity and current yield.

EXAMPLE III

As described above, α-picoline was subjected to electrochemical oxidation at 40° C. at a lead-silver anode with 2.75% (wt) silver. Between brackets the results are given of a comparative experiment with a lead anode. α-picolinic acid was formed with a selectivity of 65% (40%) and a current yield of 45% (25%).

Selectivity and current yield were independent of charge Q passed through (1–12 F/mole).

At the lead anode the amount of waste gas ($O_2$ and $CO_2$) formed was much larger than at the lead-silver anode; moreover, there was a marked difference in cell voltage 4.5 V (6 V). The use of the lead anode involved a much stronger colouration of the anolyte.

EXAMPLE IV

In a manner similar to that of example III 5-ethyl-2-methyl pyridine was oxidized. The principal products formed in the process were 2,5-pyridine dicarboxylic acid (2,5-PDC) and 6-methyl nicotinic acid (6-MNA).

The differences between the lead-silver anode (2.75% (wt) silver) and the lead anode are apparent from table 4 below and from the differences in cell voltage 4.5 V and (6 V), as well as from a lower waste gas flow and the light colouration of the anolyte in the use of the lead-silver anode.

TABLE 4

| charge Q (F/mole) | conversion substrate (%) | Selectivity 2,5-PDC (%) | Current yield (%) |
|---|---|---|---|
| 2 | 28 (24) | 31 (22) | 84 (47) |
| 6 | 75 (63) | 27 (25) | 55 (40) |
| 12 | 90 (90) | 25 (22) | 36 (27) |
| 18 | 99 (99) | 19 (18) | 21 (17) |

These figures show that this electro-oxidation is performed preferably at lower conversions.

EXAMPLE V

In a manner similar to that of example IV 2,6-lutidine was oxidized. The principal products formed in the process were 6-methyl picolinic acid (6-MPA) and 2,6-pyridine dicarboxylic acid (2,6-PDC).

The selectivity in respect of 6-MPA was 70% (not determined for the lead anode) and of 2,6-PDC 10% (5%), the current yield in respect of 6-MPA 35% (not determined for the lead anode) and of 2,6 PDC 10% (<5%). In consequence of decarboxylation, picolinic acid was formed as well, with a selectivity of about 15% (not determined for the lead anode) and a current yield of 20% (not determined for the lead anode).

The yields and selectivities are stated at 50% conversion.

EXAMPLE VI

In a manner analogous to examples III-V the following materials were respectively subjected to electrochemical oxidation:

a. 2-methyl-3-methoxy pyridine.
   In the conversion into 3-methoxypicolinic acid, with a charge of 6 F/mole, the selectivity was found to be 50% and the current electrical yield 25% on average.
b. 2-amino-4-methylthiazole.
   In the conversion into 2-amino-thiazole-4-carboxylic acid, with a charge of 2 F/mole, the selectivity was 60% and the current yield 83%.
   When the charge was increased to 6 F/mole, the selectivity dropped to 30% and the current yield to 63% for this conversion.
c. 4-methyl-imidazole.
   In the conversion into imidazole-4-carboxylic acid the current yield fell as the charge was increased, and that from 55% at 1 F/mole to 20% at 3 F/mole.
   With an even higher charge, $CO_2$ would be formed almost exclusively in consequence of complete oxidation.
   Consequently, this oxidation reaction offers prospects only at low conversions. Then a selectivity of 20% will be reached.

EXAMPLE VII

With 2,3-lutidine as starting material to be oxidized and a lead-silver anode (2.75% (wt) silver) and a Pt cathode as electrodes, each having an active electrode surface of $4\times4$ $cm_2$, electrochemical oxidation was carried out at a temperature of 60° C. in otherwise the same manner as in examples III up to and including VI.

In successive experiments the current density was varied. The results are summarized in table 5.

TABLE 5

| Current density ($A/m^2$) | Selectivity 2,3 PDC (%) |
|---|---|
| 1000 | 66 |
| 1500 | 65 |
| 2000 | 62 |
| 4000 | 38 |
| 6000 | 19 |

EXAMPLE VIII

In a manner analogous to that of example VII, this time at 1000 $A/m^2$, the temperature was varied. The results are shown in table 6.

TABLE 6

| Temperature (°C.) | Selectivity 2,3-PDC (%) | Current yield (%) |
|---|---|---|
| 25 | 35 | 20 |
| 40 | 60 | 40 |
| 60 | 65 | 45 |
| 70 | 40 | 30 |
| 80 | 20 | 15 |

We claim:

1. Process for the electrochemical oxidation of organic products at a lead-silver anode in acid medium, characterized in that the organic products used are alkyl-substituted heterocycles and that a lead-silver anode is used with 2–10% (wt) silver.

2. Process according to claim 1, characterized in that the anode contains 2.6–8% (wt) silver.

3. Process according to claim 1, characterized in that the anode also contains one or more of the metals antimony, cadmium, calcium, cobalt, tellurium, thorium, tin or zinc in an amount of 0.01–0.7% (wt).

4. Process according to claim 1, characterized in that the acid used is sulphuric acid or phosphoric acid.

5. Process according to claim 1, characterized in that a current density of 100–10,000 $A/m^2$ is applied.

6. Process according to claim 1, characterized in that the alkyl-substituted heterocycles used are mono and dimethylsubstituted pyridines.

7. Process according to claim 6, characterized in that the organic product used is 2,3-lutidine.

8. Process according to claim 1, characterized in that the electrochemical oxidation is carried out at a temperature between 20°–90° C.

* * * * *